United States Patent [19]

Bailey et al.

[11] 4,206,820

[45] Jun. 10, 1980

[54] STRIKING BAR

[75] Inventors: Edward A. Bailey, Newport; Louis H. LeBlanc, Jr., Claremont, both of N.H.

[73] Assignee: Joy Manufacturing Company, Pittsburgh, Pa.

[21] Appl. No.: 865,087

[22] Filed: Dec. 27, 1977

Related U.S. Application Data

[63] Continuation of Ser. No. 722,920, Sep. 13, 1976.

[51] Int. Cl.[2] ..... B25D 9/00

[52] U.S. Cl. ..... 173/105; 279/19.3

[58] Field of Search ..... 173/105, 106, 107, 108; 279/19.3, 19.6, 19.7, 78, 79; 408/226, 239

[56] References Cited

U.S. PATENT DOCUMENTS

| | | | |
|---|---|---|---|
| 1,649,651 | 11/1927 | Bayles | 279/19.3 |
| 1,822,115 | 9/1931 | Shepherd | 279/19.3 |
| 2,278,931 | 4/1942 | Katterjohn | 279/19.3 |
| 2,385,349 | 9/1945 | Curtis | 279/19.3 |
| 2,477,054 | 7/1949 | Gartin | 279/19.3 |
| 2,776,040 | 1/1957 | Schorer | 279/19.3 |
| 3,797,584 | 3/1974 | Bailey et al. | 279/19.3 |

*Primary Examiner*—Albert A. Hafer

*Attorney, Agent, or Firm*—J. Stewart Brams

[57] ABSTRACT

This invention relates to improvements in working member assemblies and is described hereinbelow with particular reference to a novel striking bar assembly for use in open front type rock drills.

12 Claims, 4 Drawing Figures

STRIKING BAR

This is a continuation of application Ser. No. 722,920, filed Sept. 13, 1976.

Prior rock drills have commonly been provided with a striking bar assembly including an elongated striking bar which is retained within and extends outwardly of the forward end of the drill for actuation in one or more drilling modes such as simultaneous percussive and rotary actuation to drill a bore hole by means of an elongated drill string secured to the free end of the striking bar. Such prior drills generally may be classified as open front end drills if the structure of the striking bar retention means therein permits removal or insertion of the striking bar without any drill disassembly. Examples of known open front drills are the lug types wherein lugs formed intermediate the ends of the striking bar cooperate with groove means in the drill chuck to secure the striking bar in the manner of a bayonet lock, and the latching type wherein a latch member is carried adjacent the forward end of the drill to secure the striking bar by engaging a peripheral portion thereof.

Although heretofore known striking bar assemblies for open front type drills have generally served the intended purposes, they have nevertheless often been subject to serious deficiencies. For example, in many open front drills striking bar removal and replacement requires the striking bar to be passed axially through the bearing portion of the forward bushing, and the maximum striking bar diameter thus has often been limited to the internal bearing diameter of the forward bushing. In such cases it has been impossible to provide a striking bar with a desirably enlarged rearward end portion. Other striking bar design considerations arising from the requirement for compatibility with open dront drills have seriously limited the available design options for striking bar lubrication, venting and rotary driving in such drills.

These and other deficiencies of the prior art are alleviated by the present invention which in its preferred embodiment provides a novel striking bar assembly for an open front end type drill wherein the striking bar includes an enlarged rearward end portion and enlarged intermediate driver portion, both of which are able to be passed axially through a forward support bushing having a bearing surface diameter smaller than the nominal diameter of either such rearward end portion or driver portion. The novel striking bar assembly of this invention additionally provides improved venting and lubrication through axially extending passageway means formed in the enlarged diameter rearward end portion thereof.

It is therefore an object of this invention to provide an improved working member assembly;

A more specific object of the invention is to provide an improved striking bar assembly for use in open front rock drilling apparatus;

A still more specific object of the invention is to provide such an improved striking bar assembly wherein enlarged portions thereof are able to pass through an encompassing bearing member having a bearing surface diameter smaller than the nominal diameter of the enlarged striking bar portions to be passed therethrough.

These and other objects and advantages are more fully specified in the following description of the invention with reference to the accompanying figures in which.

Figures 1, 2, 3, 4:
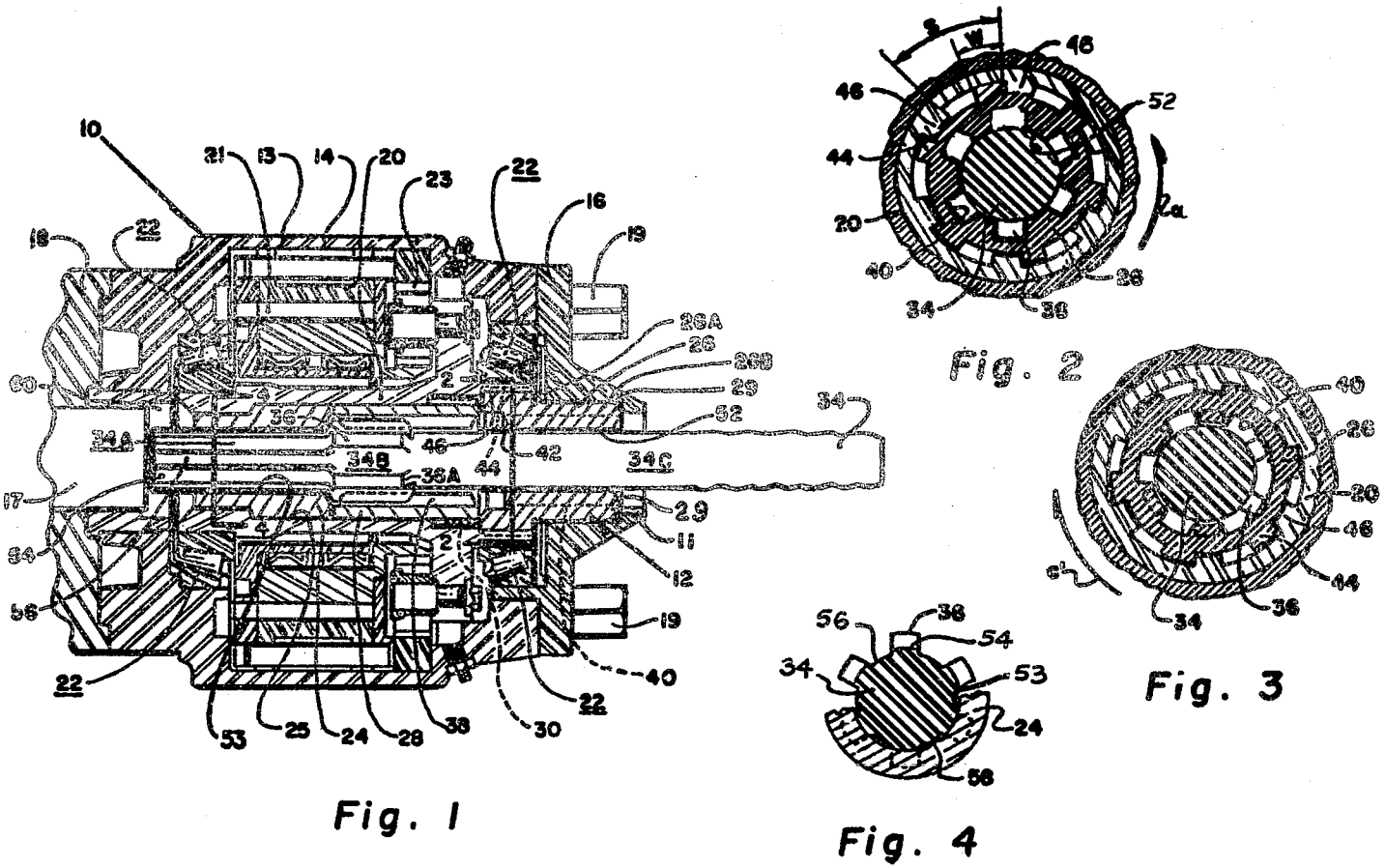
FIG. 1 is a central axial section of a rock drill forward end portion including a striking bar assembly according to one embodiment of the instant invention.
FIG. 2 is a fragmentary transverse section of the drill of FIG. 1 taken on line 2—2 of FIG. 1 and showing the striking bar assembly in the open or nonretained state.
FIG. 3 is a transverse section similar to FIG. 2 with portions broken away to show the striking bar assembly in the closed or retained state.
FIG. 4 is a fragmentary transverse section of FIG. 1 taken on line 4—4 of FIG. 1.

There is generally indicated at 10 in FIG. 1 the forward end portion of a powered actuator or tool means, shown as a percussive rock drill and including a yoke portion 13 which carries therewithin an elongated generally cylindrical striking bar 34 retained within yoke portion 13 by means generally indicated at 12 and more completely described and claimed in copending application Ser. No. 722,811 of E. A. Bailey entitled "Drill" which is assigned to the same assignee as the instant application and was filed contemporaneously herewith, and now U.S. Pat. No. 4,106,573.

Yoke 13 comprises an elongated, generally cylindrical housing 14 rigidly secured coaxially intermediate a generally annular front cap 16 and an elongated percussion portion 18 (forward end only shown) by any suitable means for example, a plurality of longitudinally extending conventional side rods (not shown) secured by threaded fasteners 19.

In operation a hammer piston 17 suitably reciprocably carried within portion 18 is actuated to repetitively impact the rearward end of striking bar 34 simultaneously with independent axial rotation of striking bar 34 by means described hereinbelow to provide a rotary, percussive drilling action for drilling bore holes in hard formations such as rock. Striking bar 34 is supported coaxially within an elongated annular chuck member 20 which, in turn, is rotatably journaled within housing 14 by axially spaced, annular roller bearing assemblies 22 for rotation by any suitable drive means such as an annular motor means 21 and planetary gear train 23 which are more fully described in U.S. Pat. No. 3,858,666.

Member 20 includes a stepped cylindrical inner periphery 25 wherein a generally annular rear chuck bushing 24 is press-fitted coaxially adjacent the rearward end thereof. An elongated annular chuck driver 28 is similarly press fitted within periphery 25 coaxially forwardly adjacent bushing 24 and additionally is nonrotatably keyed to chuck member 20 for rotary driving thereby as by respective pluralities of intermeshed splines 30 spaced circumferentially about adjacent peripheral portions of driver 28 and member 20. A generally annular elongated forward bushing or bearing member 26 is located coaxially forwardly adjacent driver 28 such that a rearward end portion 26A thereof is engaged in rotary driving engagement within the forward end of chuck inner periphery 25 and a forward end portion 26B thereof is rotatably supported within a cylindrical inner periphery 11 of cap 16. Cap 16, when assembled to housing 14, captively retains chuck member 20 and bearings 22 within housing 14 with bushing 24 and driver 28 carried therewithin as described. Cap 16 additionally captively retains bushing 26 coaxially intermediate a rearwardly facing annular thrust bearing surface 29 thereof and driver 28.

The coaxially aligned inner peripheries of rear bushing 24, driver 28 and forward bushing 26 are sized to receive striking bar 34 therewithin with axially aligned rearward and forward striking bar portions 34A, 34C rotatably supported within respective bushings 24,26. An enlarged striking bar portion 34B axially intermediate portions 34A, 34C includes a plurality of circumferentially spaced, radially outward extending drive splines 36 which are engaged in rotary driving engagement with cooperably formed splines 38 spaced circumferentially about the inner periphery of driver 28 whereby striking bar 34 may be driven in axial rotation by motor 21.

In order to permit removal and insertion of striking bar 34 in yoke portion 13 without disassembly of cap 16 from the drill, all portions of the striking bar 34 located within yoke portion 13 are able to pass axially through bushing 26. Accordingly, the inner periphery of bushing 26 includes a radially inner, circumferentially segmented bearing surface means 52 which rotatably supports forward striking bar portion 34C, and a plurality of circumferentially spaced, axially extending grooves 40 (FIGS. 1 and 2) sized and located to receive splines 36 such that when the splines 36 are circumferentially aligned with grooves 40 as in FIG. 2 striking bar 34 may be passed axially through bushing 26 as desired. When splines 36 are circumferentially misaligned with grooves 40 FIG. 3) striking bar 34 is retained within chuck portion 13 by abutment of a forward axial end 36A of splines 36 upon circumferentially spaced rearward end surface portions 42 of bushing 26 formed circumferentially intermediate grooves 40.

Bushing 26 rearward end portion 26A is keyed in rotary driving engagement with chuck member 20 by respective cooperating pluralities of circumferentially spaced splines 44 and 46 (FIGS. 1, 2 and 3) to be driven in axial rotation at the same rotary speed as striking bar 34. As shown in FIG. 2, the circumferential spacing "S" between adjacent splines 46 is approximately twice the width "W" of splines 44 and the resulting lost motion rotary connection therebetween permits sufficient relative axial rotation between bushing 26 and striking bar 34 to provide the desired alignment and misalignment of grooves 40 and splines 36 as described in the hereinabove referenced copending application Ser. No. 722,811.

Like the striking bar driver portion 34B, end portion 34A is of a larger nominal diameter than inner periphery 52 of bushing 26 through which striking bar 34 is passed during removal and replacement thereof. More specifically, rearward end portion 34A is of larger nominal diameter than the forward end portion 34C by virture of having a plurality of circumferentially spaced, axially extending lands 54 (FIGS. 1 and 4) aligned with ones of splines 36, and intervening, axially extending undercut grooves 56, the diameter across which grooves 56 is substantially the same as or smaller than the diameter of forward end portion 34C. The nominal outer diameter of rearward end portion 34A as defined by the diameter across lands 54 thus is larger than the diameter of bearing surface 52 in bushing 26. During striking bar removal and replacement the lands 54, which are aligned with ones of splines 36, register with respective grooves 40 and therefore do not interfere with smaller diameter bearing surface portions 52. Likewise, grooves 56, being of the same or smaller diameter than portion 34C, pass through forward bushing 26 in register with bearing surface portion 52 whereby the entire striking bar 34 including enlarged diameter rearward end portion 34A is able to be passed axially through forward bushing 26.

The described striking bar assembly affords numerous advantages not available heretofore in open front drills. For example, throughout the axial engagement of portion 34A within rear bushing 24, the grooves 56 cooperate with the bearing surface area 53 of bushing 24 to provide axially extending clearance spaces 58 circumferentially intermediate adjacent lands 54 through which otherwise isolated regions such as at 60 adjacent the impact end of piston 17 (FIG. 1) may be vented to the atmosphere to preclude fluid pressure accumulations therein. Clearance spaces 58 additionally may be used to conduct lubricant, perhaps in the form of an air-oil mist, to lubricate wear surfaces in yoke portion 13. Furthermore, the striking bar rearward end portion 34A is not limited to the standardized nominal diameter of the forward end portion 34C which is determined in part by the dimensions of commercially available drill steels and couplings. The enlarged nominal diameter of portion 34A provides added material mass and strength which is highly desirable to better sustain the impact blows of piston 17, particularly in view of such known mass and strength deficiencies as resulting from an enlarged coaxial bore (not shown) commony formed in the striking bar rearward end to receive a flushing fluid tube.

According to the description hereinabove the present invention provides a novel striking bar assembly particularly well suited for use in an open front rock drill wherein a rearward end bearing portion and an intermediate driver portion of the striking bar both of which are of larger nominal diameter than the striking bar forward end portion, are able to be passed through a forward bushing which rotatably supports such forward end portion. Notwithstanding the description hereinabove of a particular preferred embodiment of the invention it is to be understood that this invention may be practiced in numerous alternative embodiments with various modifications thereto without departing from the broad spirit and scope thereof. For example, various alternative configurations and numbers of the splines 36 on striking bar 34 may be employed; striking bar portions 34A, 34B and 34C are generally axially aligned but need not necessarily be coaxially aligned; various alternative striking bar securing and release means may be employed as well as alternative rotation motors and drill actuating means; the particular configuration of rearward end portion 34A and of the inner periphery of bushing 26 may be varied within a wide design latitude; and the like.

These and other embodiments and modifications having been envisioned and anticipated by the inventors, the invention should be construed broadly and limited only by the scope of the claims appended hereto.

What is claimed is:

1. In an impact tool means, a working member assembly comprising:

an elongated working member having at least a pair of axially aligned support portions and a rotary driver portion;

elongated bearing means adapted to be carried by such impact tool means and cooperable with said working member to supportingly engage said support portions of said working member;

said bearing means including a pair of bearing portions with each of said bearing portions being formed to supportingly encompass a respective one of said pair of support portions for support of said working member in a manner to permit rotation thereof with respect to said bearing portions;

and one of said support portions of said working member having a transverse extent greater than the transverse extent of the other of said support portions and being cooperable with the said bearing portion which supportingly encompasses said other support portion to be moveable axially therethrough for removal and insertion of said working member from and into said bearing means.

2. A working member assembly as claimed in claim 1 wherein said rotary driver portion includes a transverse extent thereof which is greater than the transverse extent of said other support portion; and said rotary driver portion being cooperable with the said bearing portion which supports said other support portion to be moveable axially therethrough for removal and insertion of said working member from and into said bearing means.

3. A working member assembly as claimed in claim 2 wherein said support portions are generally cylindrical and said one support portion has a diameter larger than the diameter of said other support portion.

4. A working member assembly as claimed in claim 2 wherein said rotary driver portion includes a plurality of circumferentially spaced splines and said splines include a transverse extent which is greater than said transverse extent of said other support portion.

5. A working member assembly as claimed in claim 3 wherein said bearing portions include generally cylindrical bearing surface areas engagable with the respective said support portions to axially rotatably support said working member for rotation with respect to said bearing means.

6. A working member assembly as claimed in claim 5 wherein said one support portion includes a plurality of circumferentially spaced support lands and intervening grooves and the diameter of said one support portion is the outer diameter of said lands.

7. A working member assembly as claimed in claim 6 wherein said cylindrical bearing surface area engaging said other support portion is of a diameter smaller than said diameter of said one support portion.

8. In an elongated striking bar for use in an open-ended impact tool and including at least a pair of axially spaced apart support portions and a rotary driver portion, and wherein said striking bar is adapted to be supported with respect to such impact tool by insertion of said striking bar into the open end of such impact tool such that at least said pair of support portions engage a respective pair of bearing means carried by such impact tool, the improvement comprising:

one of said support portions of said striking bar being adapted to be received, during such insertion of said striking bar into such impact tool, into supporting engagement with one of such bearing means for rotation with respect thereto after being passed through an interior space defined and encompassed by the other of such bearing means, and said one support portion of said striking bar having a transverse extent greater than the maximum transverse extent of the other of said support portions.

9. A striking bar as claimed in claim 8 wherein said rotary driver portion is located axially intermediate said pair of support portions.

10. A striking bar as claimed in claim 8 wherein said support portions include generally cylindrical means coaxial with respect to the axis of said striking bar and said transverse extent of each of said support portions is the outer diameter of said generally cylindrical means.

11. A striking bar as claimed in claim 10 wherein said one support portion includes a plurality of circumferentially spaced, radially outwardly projecting lands.

12. A striking bar as claimed in claim 8 wherein said other support portion is adapted to be received into supporting engagement with said other bearing means for rotation with respect thereto.

* * * * *